US005130047A

United States Patent [19]

Nágel

[11] Patent Number: 5,130,047

[45] Date of Patent: Jul. 14, 1992

[54] GETTER-COMPOSITION FOR LIGHTSOURCES

[75] Inventor: Ferenc Nágel, Budapest, Hungary

[73] Assignee: Tungsram Tr., Budapest, Hungary

[21] Appl. No.: 509,339

[22] Filed: Apr. 13, 1990

[30] Foreign Application Priority Data

May 17, 1989 [HU] Hungary ..... 2443/89

[51] Int. Cl.[5] ..... H01J 7/18; H01K 1/56

[52] U.S. Cl. ..... 252/181.6

[58] Field of Search ..... 252/181.6, 181.2

[56] References Cited

U.S. PATENT DOCUMENTS

| | | | |
|---|---|---|---|
| 3,654,533 | 4/1972 | della Porta et al. | 317/258 |
| 3,926,832 | 12/1975 | Barosi | 252/181.6 |
| 4,119,488 | 10/1978 | Barosi | 252/181.6 |
| 4,124,659 | 11/1978 | della Porta et al. | 264/0.5 |
| 4,203,049 | 5/1980 | Kuus | 252/181.6 |
| 4,874,339 | 10/1989 | Bratz | 252/181.6 |
| 4,970,114 | 11/1990 | Baldi | 428/326 |

FOREIGN PATENT DOCUMENTS

| | | |
|---|---|---|
| 3225751 | 1/1984 | Fed. Rep. of Germany . |
| 3322637 | 1/1984 | Fed. Rep. of Germany . |
| 7344925 | 12/1974 | France . |
| 2077487 | 12/1981 | United Kingdom . |

OTHER PUBLICATIONS

"Zirconium-Aluminum Allow as a Getter for High Intensity Discharge Lamps", Proc. 6th Int'l. Vacuum Cong. 1974, Japan, J. Appl. Phys. Suppl. 2, Pt. 1, 1974.

"Mercury Dispensing and Gettering in Fluorescent Lamps", by P. della Porta & E. Rabusin, Proc. 6th Int'l. Vacuum Cong. 1974, Japan J. Appl. Phys. Suppl. 2, Pt. 1, 1974.

"Sorbtion of Active Gases by Non-Evaporative Getter", by Surya Parkash and P. Vijendran of Bhaba Atomic Research Center, Vacuum/vol. 33/No. 5, pp. 295 to 299/1983.

*Primary Examiner*—Robert L. Stoll
*Assistant Examiner*—Joseph D. Anthony
*Attorney, Agent, or Firm*—Michael N. Meller

[57] ABSTRACT

The invention relates to a composition containing a material with getter effect in fine distribution accompanying metals and a carrier.

The composition contains 20–80 vol-% volatile solvent, in particular petrol, as carrier, related to the total quantity of metals, as metallic component 30–70 mass-% zirconium-alloy, 15–30 mass-% nickel and the remaining part is aluminium with a laminar morphology.

12 Claims, No Drawings

GETTER-COMPOSITION FOR LIGHTSOURCES

The present invention relates to a so-called spreadable getter composition containing a material with getter effect, i.e. an active substance being able to bind small quantities of gases or vapours being present or formed in a closed space.

Getters are substances being able toreact with or absorb gases or vapours in a small quantity, either forming a compound, which is not volatile and being neutral in respect to the space or means which are intended to be gettered, or removing them from the space, collecting them in their own material and keeping them in a bound state. Some getter compositions exert simultaneously both effects.

Getters have been widely, used in the industry producing lightsources, as it is indispensable that the space in which light is generated, should only contain materials needed for the function of the lightsource and no deteriorating substance should be there. Deteriorating materials may get into the space in course of production as residues. On the other hand, they may evaporate from the materials, of the light source during operation such remnant gases and vapours are oxygen, hydrogen, carbon dioxyde, carbon monoxyde steam etc. Steam is particularly dangerous, as may produce hydrogen by decomposition. Decomposition may occur easily in course of operation of the lightsource on the surface of the hot metal. On the other hand nascent oxygen produced in that way forms a metal oxyde, which may precipitate on the wall of the bulb, wherein nascent hydrogen reduces it again to metal appearing as a black spot. Thereafter, steam will composed again and the process described is repeated. Said process can be prevented by binding hydrogen. Accordingly, hydrogen plays a cardinal role in operation of the lightsource and determines useful life of the lightsource. Therefor its binding is very important.

Metal getters belong to the group of getters having been used in lightsources. They are heat-resistent metals which are able to dissolve harmful materials, first of all hydrogen, in itselves. The following metals may be used advantageously as getters: titanium, tantalum or zirconium. The latter is considered as most useful, mainly by virtue of its hydrogen binding ability.

In the lightsource industry, getters are spread onto the space to be gettered. These mixtures to be spread contain substances with a getter-effect either in form of pulverized metal or suspended in some carrier. Frequently said suspension is applied onto the current leading wire in electric bulbs. The suspension adheres to the current lead-in and upon the effect of the heat in course of the production, volatile and decomposed components of the suspension leave the space to be gettered, mostly the components are sucked away by the vacuum.

It goes without saying that the components of the suspension leaving the space in course of production can not be chosen freely. First of all, these components should leave the space completely and they should be in anhydrous state. Getter suspensions used in production of lightsources frequently contain carbonaceous binding materials as carriers which are dissolved in some solvent. Nitrocellulose binding material e.g. may be used to spreadable getters. When this binding material becomes decomposed, however, it produces steam, hydrocarbons and carbon oxydes. For this reason there was a demand to develop a binding material which does not produce harmful materials in a decomposed state.

In the DE-OS 2 740 602, metal-chlorids are proposed as binding material for getter compositions used in halogen lamps, ethanol is used, as a polar solvent, which evaporates easily in vacuum in course of lamp production.

In course of our experiments it has been found, that spreadable getter compositions can be prepared without any binding material, if the metal components are properly selected. As a consequence, disadvantages accompanying decomposition of binding materials can be avoided, and volatile solvents suffice, as carrier materials. Absolute alcohol and mostly anhydrous petrol are considered as advantageous for this purpose.

It was also recognized that the use of pure metals —in particular zirconium in itself—is not advantageous for spreadable getters. Pulverized zirconium can be separated from the hydrogen contained with difficulties only, it often happens that a thick oxyde-nitride layer is formed on the grain surfaces. Accordingly, gettering effect of the metal will prevail at too high temperatures only. In addition, zirconium can be ground difficulty, it is a ductile metal, so production of pulverized metal is wearisome.

Accordingly, a zirconium alloy is used for spreadable getter compositions instead of pure zirconium. Zirconium alloys show an excellent hydrogen binding ability, the more, certain compositions even surpass the effect of pure zirconium. This effect is discussed by Kenji Ichimura et a., (J.Vac.Sci. 1988 vol.6. number 4, pages 2541-5), dealing with problems connected to compact band-shaped zirconium and zirconium alloys, but not touching the characteristics of metal powders. As it is well known, only pulverized zirconium can be used for spreadable gettering means, the characteristics of which —as it is well known—are not in compliance with those of compact metals.

For getter compositions, metal alloys can be favourably used, which are rigid, can easily be grounded and hydrogen binding ability of which is at least identical with that of the zirconium. Some known zirconium alloys meet these requirements, e.g. first of all the zirconium-aluminium alloy indicated with "St 101", but other alloys, as e.g. the zirconium vanadium-iron alloy "St 707" or the zirconium-nickel alloy "St 199" are suitable too. Otherwise, these alloys are described in the periodical cited above.

Accordingly, any zirconium alloy can be used for spreadable getter compositions, which is grindable, its hydrogen binding ability is at least identical with that of the zirconium and does not exert its gettering effect below 350° C. This last requirement is of utmost importance, namely the thermal effect arising in course of production, amounting maximally to 350° C., could not ruin gettering effect of the pulverized alloy. In connection with these requirements composition and grainsize of the alloy is to be chosen in a way, that the alloy should not be pyrophorous and should not react vehemently with air at the soldering temperature.

It has also been recognized, that in addition to the pulverized alloy representing the active ingredient, pulverized nickel and aluminium are to be admixed to the spreadable gettering means, to achieve proper sintering on the carrier element onto which it was spread.

Pulverized nickel is contained as an independent component in our composition, but it may be present as an alloying component as well with zirconium as basic metal. The alloyed nickel, however, doesn't substitute the pulverized nickel, as it represents a most important factor of the getter composition.

The getter composition according to the invention differs essentially from the composition having been described e.g. in the periodical Vacuum (1980. volume 30, number 6, pages 213-16) and from the gettering composition according to the DE-OS 2 827 132, which specify gettering effect of zirconium-nickel alloys and sinter bodies. For the sake of order it should be mentioned that the DE-OS 2 827 132 is dealing with pulverized zirconium metal and pulverized nickel forming a continuous unit therewith and not with pulverized zirconium alloy and pulverized nickel. There is a further essential difference between the two compositions, namely the cited one contains a binding material.

In contrast to the cited composition we do not use binding material at all, pulverized nickel is proposed as an independent component, playing a double role. It promotes process of sintering and increases gettering effect of zirconium alloy. Nickel being in contact with zirconium alloy within the composition promotes the possibility that the alloy should be able to take up hydrogen at a lower temperature. As a consequence, difficulties accompanying activation do not appear. Hydrogen molecules impacting on the getter grain have to diffuse on the gases having been adsorbed on the grain surface and thereafter on the thin oxyde-nitride layer. Then it can be dissolved—in case of a molecule dissociated—in atomic form in the alloy. In case, if the alloy grain contacts in a metallic way with nickel, hydrogen atom diffuses from nickel into the alloy grain. That means that hydrogen can be dissolved more easily into the nickel grain due to a thinner adsorbed gas and oxyde layer. For the sake of order it should be mentioned that nickel can be substituted by any other metal being suitable for catalytic hydrogenation, so e.g. partly or completely by cobalt.

We also recognized that laminar aluminium in a fine distribution is to be used in the composition. With respect to morphology, this type of aluminium is similar to the quality of "silver dyestuff". Aluminium particles play a most important part, as aluminium has to fulfil the substituting role of binding material.

The getter composition according to the invention, mainly for electric bulbs, consisting of the getter metal and another accompanying metal and a solvent. The composition contains 20-80 vol. % volatile solvent, the remnant part comprises metals in fine distribution and so, in so far as related to the total quantity of dry substance metallic component comprises 30-70 mass-% pulverized zirconium alloy, 15-35 mass-% pulverized nickel and the remaining part consists of laminar aluminium grains.

It is considered as advantageous, if the composition contains zirconium-aluminium alloy. With a more preferred embodiment the composition contains zirconium-aluminium alloy, which contains as a complementary component up to 5 mass-% vanadium, iron and silicon.

A most preferred embodiment of the composition is prepared from the alloy-melt having been degasified by re-melting, containing ground zirconium alloy gained from precomminuted thin plates as described in the HU-PS 192 912.

According to the method described in the cited patent, re-melt degasified alloy-melt is allowed to flow through a quartz orifice onto a rotating cooled metal cylinder, where the melt is solidified to a band or pieces and broken up into thin tiny plates. This pre-product can be advantageously ground either in argon gas flow or in a preferably solvent used for the composition.

Preferably the composition according to the invention contains nickel having been reduced from nickel-formiate, with a grainsize of 1-3 μm, furtheron aluminium of the quality of "silver dyestuff".

To facilitate understanding of the invention, examples are presented without restricting the invention to the examplary embodiments.

EXAMPLE 1

Organic stabilizator adhered is released by flushing from aluminium pigment of the quality "silver dyestuff". The washed pigment should be used immediately or if it is not possible, it has to be stored under protective atmosphere, as if it is stored in air, a too thick oxyde layer will be formed on the grain surface inhibiting sintering at a relatively low temperature. From the freshly washed aluminium pigment 30% (mass-%) is to be weighed into the metallic component. Nickel of an average grain size of 1-3 μm having been reduced from nickel-formiate is admixed to the aluminium in a quantity, which equals to 20 mass-% in the metallic component.

The abovementioned two metals are mixed with 16 mass-% aluminium, 1 mass-% vanadium, 0,5 mass-% iron, as well as 0,1 mass-% silicon, all contained in the zirconium alloy. This alloy can be better poured, as if contained aluminium only. This melt alloy attacks namely less the quartz. Gettering ability complies at least to that of known zirconium-aluminium alloys. In accordance with the HU-PS 192 912 pre-comminuted alloy is ground in anhydrous petrol to the average fineness of 2 to 5 μm in a planetary mill, now this powder is admixed to the other metals, at last the metal mixture is mixed with petrol to gain a well spreadable paste. Related to the whole volume of the composition, 60-70 vol-% petrol is needed.

The composition thus gained is suitable for use in lightsources, it is a stable composition. Generally, a small quantity is applied onto the current lead-in of the lamp by means of a thin brush.

During the shutdown of the bulb the solvent evaporates from the composition, metals are sintered to the current lead-in and remain there in course of the operation of lamp.

EXAMPLE 2

We proceed in accordance with Example 1 with the difference, that grinding is performed in a mill containing argon flow, the mill is provided with a cylinder made of titanium with a diameter of 250-300 mm and a beating rod with a number of revolutions of 800-1000-/minute. Argon flow carries out the alloy grains with a diameter of 2-5 μm.

What we claim:

1. Getter composition to lightsources consisting of a metal with getter-effect in a fine distribution, and other accompanying metals also in a fine distribution, wherein it consists of 20 to 80 vol.-% volatile solvent as carrier, advantageously petrol, related to the total quantity of metals it contains as metallic component 30-70 mass % zirconium alloy, 15-35 mass-% nickel and the remaining part is aluminum with a laminar morphology.

2. Composition as claimed in claim 1, wherein the zirconium alloy comprises zirconium and aluminum.

3. Composition as in claim 1, wherein the zirconium alloy contains a metal selected from the group consisting of aluminum, vanadium, iron and silicon in a grainsize of 2 to 5 μm.

4. Composition as in claim 1, wherein the zirconium alloy is a ground material having been gained by degasifying, re-melting, quenching and pregrinding a molten alloy.

5. Composition as in claim 1, wherein the nickel component is reduced from nickel-formiate and has a grain size of 1-3 μm.

6. Compostion as in claim 1, wherein the aluminum component is a pigment in the quality of "silver dyestuff".

7. Composition as in claim 2, wherein the zirconium alloy further comprises vanadium, iron and silicon in a grainsize of 2 to 5 μm.

8. Composition as in claim 2, wherein the zirconium alloy is a ground material having been gained by degasifying, re-melting, quenching and pregrinding a molten alloy.

9. Composition as in claim 3, wherein the zirconium alloy is a ground material having been gained by degasifying, re-melting, quenching and pregrinding a molten alloy.

10. Composition as in claim 2, wherein the nickel component is reduced from nickel-formiate and has a grain size of 1-3 μm.

11. Composition as in claim 3, wherein the nickel component is reduced from nickel-formiate and has a grain size of 1-3 μm.

12. Composition as in claim 4, wherein the nickel component is reduced from nickel-formiate and has a grain size of 1-3 μm.

* * * * *